United States Patent [19]

Mason

[11] 4,218,899

[45] Aug. 26, 1980

[54] AUTOMATIC WASHER SPIN DELAY MECHANISM

[75] Inventor: Anthony Mason, Lincoln Township, Berrien County, Mich.

[73] Assignee: Whirlpool Corporation, Benton Harbor, Mich.

[21] Appl. No.: 47,747

[22] Filed: Jun. 12, 1979

[51] Int. Cl.[2] ..... D06F 37/40

[52] U.S. Cl. ..... 68/12 R; 68/23.7; 192/28; 192/35

[58] Field of Search ..... 68/12 R, 23.6, 23.7; 192/28, 35

[56] References Cited

U.S. PATENT DOCUMENTS

| | | | |
|---|---|---|---|
| 2,346,152 | 4/1944 | Clark | 68/23.6 X |
| 2,583,168 | 1/1952 | Fields | 68/23.6 |
| 2,639,794 | 5/1953 | McNairy | 192/35 X |
| 2,733,610 | 2/1956 | Lodge | 68/23.7 X |
| 2,739,682 | 3/1956 | Detwiler | 192/46 |
| 2,826,056 | 3/1958 | Bruckman | 68/23.7 |
| 2,947,159 | 8/1960 | Fernandez | 68/23.7 |
| 2,976,746 | 3/1961 | Flannery | 68/23.7 X |
| 3,017,784 | 1/1962 | Monaghan | 192/27 X |
| 3,905,247 | 9/1975 | Cook | 192/28 X |
| 3,990,554 | 11/1976 | Lowery | 192/26 |
| 4,029,184 | 6/1977 | Kindig et al. | 192/28 |
| 4,038,841 | 8/1977 | Bright | 68/23.6 X |
| 4,050,560 | 9/1977 | Torstenfelt | 192/85 AT |

*Primary Examiner*—Philip R. Coe

*Attorney, Agent, or Firm*—Hill, Van Santen, Steadman, Chiara & Simpson

[57] ABSTRACT

A delay mechanism for providing a delay in the spin cycle of an automatic washer is operated by means of a pawl pivotable about a stud rotating on an eccentric, which in turn is engageable with a spin gear only in one direction of rotation, and thereby provides a delay of substantially one revolution of the eccentric upon a change in direction of rotation of the eccentric.

9 Claims, 12 Drawing Figures

AUTOMATIC WASHER SPIN DELAY MECHANISM

BACKGROUND OF THE INVENTION

1. Field of the Invention

The present invention relates generally to automatic washing machines and more particularly to drive mechanisms therefor.

2. Description of the Prior Art

Heretofore laundry appliances having programmed multiperiod washing and drying cycles have utilized delays between portions of the cycle. For example, as disclosed in U.S. Pat. No. 4,038,841, a water level sensor is utilized to delay spin tub rotation until a selected quantity of water has been pumped out of the tub.

In U.S. Pat. No. 4,050,560 an outer circular member is driven by means of pawls engaged in ratchet teeth on an inner surface of the outer member. The pawls are moved into place by means of selectively actuatable hydraulic pistons.

Many laundry appliances operate automatically through a programmed cycle consisting of various washing, rinsing and drying periods. During the wash portion, agitator means are actuated in a treatment zone to flex the clothes in the presence of a laundry liquid. Upon the completion of the wash portion, the water is drained from the wash basket and the basket is rotated at a high speed to centrifugally remove laundry liquid or rinse water from the clothes.

SUMMARY OF THE INVENTION

An automatic washer of the present invention utilizes a single motor and drive mechanism to operate a vertical axis agitator and a clothes basket during washing and drying portions of a complete cycle. A rack and pinion means is provided to translate rotational movement of the motor to oscillatory movement of the agitator during the wash portion of the cycle. The oscillatory means must then be disengaged by means of a jaw clutch so that it is free to rotate with the basket at high speed during a spin portion of the cycle. The jaw clutch is provided to cause engagement and disengagement of the oscillatory means with the agitator upon a change in direction of rotation of the motor. The disengagement means requires one complete rotation of a drive gear to insure complete disengagement. In accordance with the present invention, a minimum delay of substantially one revolution of the drive gear is provided to insure that rapid spinning of the basket does not begin prior to disengagement on the oscillatory means.

More specifically a spin gear engaged with the basket has an annular channel on a lower surface thereof. The gear is mounted on a jack shaft parallel to the agitator shaft which jack shaft also has mounted thereon a separately rotatable eccentric. A rotatable pawl is pivotally mounted on the eccentric so as to rotate inside the annular channel in the spin gear. The outer wall of the annular channel in the spin gear has a surface protruding radially inwardly therefrom. In one direction of rotation, a first end of the pawl repeatedly passes the surface without engagement therewith. Upon a change in the direction of rotation of the pawl to a second opposite direction, a second end of the pawl engages the radially inwardly extending surface, thereby moving the spin gear co-rotatably with the rotating eccentric.

The means to pivot the pawl into or out of engagement with the inwardly extending surface includes a lever frictionally coupled to an interior hub of the channel in the spin gear, thus requiring the pawl to rotate substantially one revolution upon a change to the second direction of rotation before contacting the lever and being pivoted by the lever for engagement with the surface. Thus, the requisite delay of one revolution of the drive gear is provided.

DESCRIPTION OF THE PREFERRED EMBODIMENTS

Figure 1:
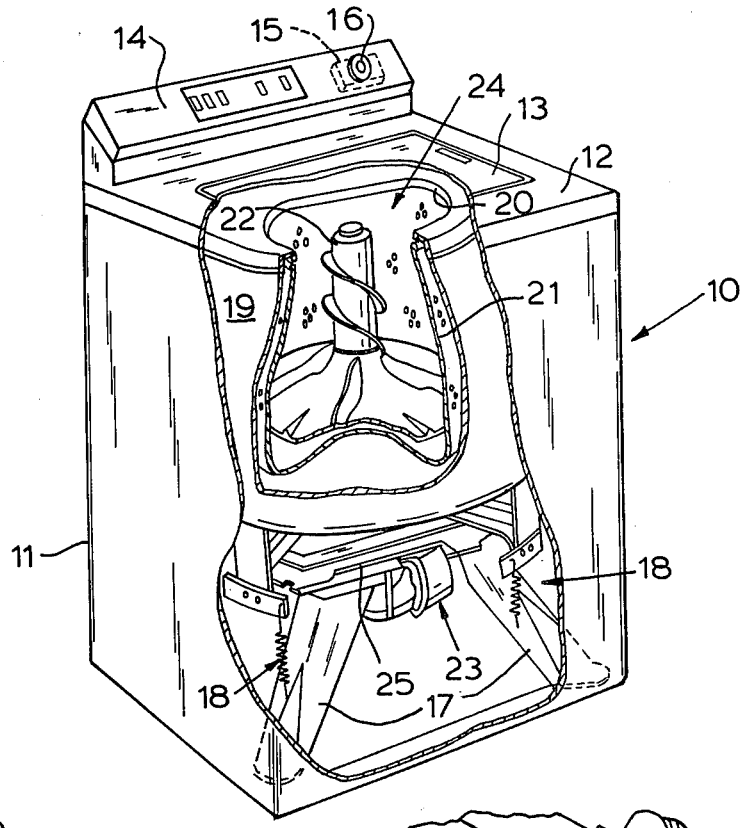
FIG. 1 is a perspective view, partly broken away, of an automatic laundry appliance embodying the present invention.
Figure 10:
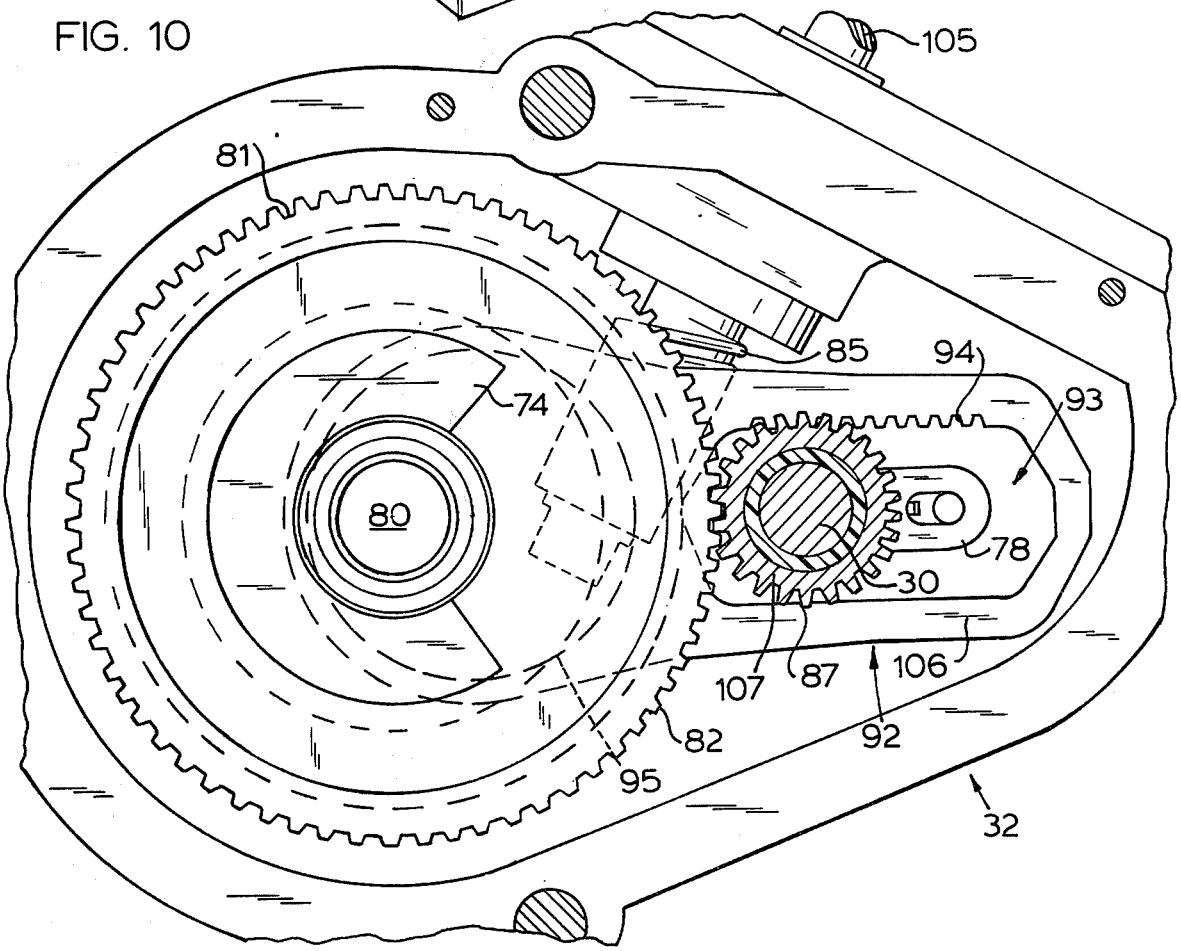
FIG. 10 is a sectional view taken along line X—X of FIG. 3.

An automatic laundry appliance is generally illustrated in FIG. 1 at 10 and comprises a tub 19 which has a perforated clothes container or spin basket 21 contained therein and an agitator 22 disposed within the spin basket 21 and mounted for oscillatory movement with respect thereto on a vertical axis. The basket 21 is mounted for spinning movement during centrifugal extraction of water from the clothes within the basket 21. The tub 19, the spin basket 21, the agitator 22 and a drive mechanism 23 therefor are contained in a cabinet 11.

Figure 2:
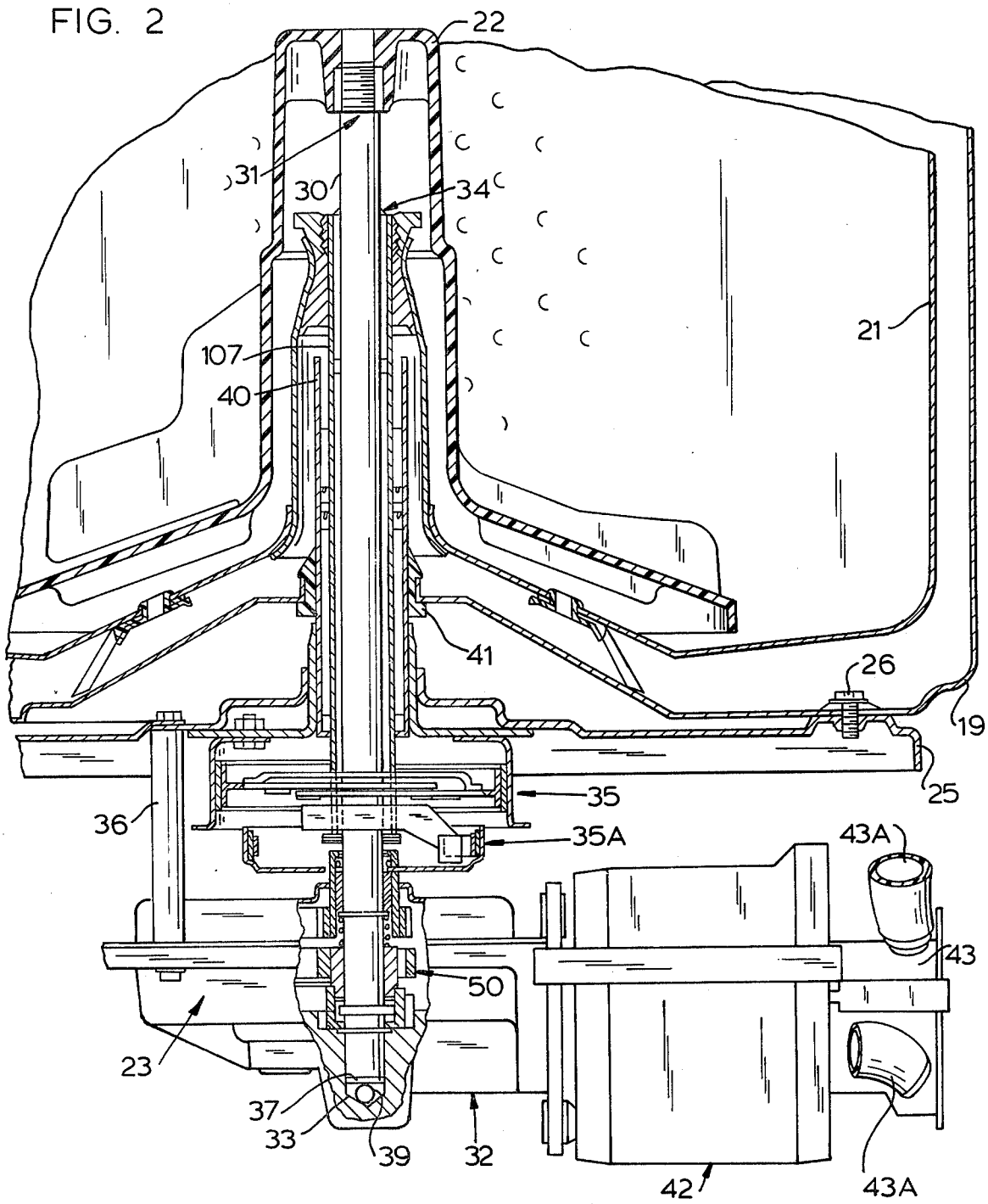
FIG. 2 is an enlarged cross-sectional view of the tub and transmission housing of the laundry appliance of FIG. 1.

The cabinet 11 has a top 12 having a hinged lid 13 which is opened to afford access to a clothes-receiving opening 24 defined by a tub ring 20 extending about the tub 19 and circumscribing a corresponding opening in the spin basket 21. The cabinet 11 also houses a presettable sequential control means 15, generally comprising a timer having a timer dial 16 connected thereto and mounted on a control panel portion 14 of the cabinet 11. The timer dial 16 and the control means 15 may be mounted in any desired location. Suitable wiring connects the control means 15 to a prime mover motor of the drive mechanism 23 and to other electrical components of the appliance as is well known in the art. The control 15 provides automatic operation of the appliance 10 through a pre-set sequence or program of operation including a wash or agitate period where the agitator 22 is oscillated to agitate a clothes load contained in basket 21 followed by a spin or dry period wherein the basket 21 is rotated to centrifuge wash liquid from the clothes load while the agitator is freed from oscillation to rotate with the basket. All components inside the cabinet 11 are supported by struts 17, having a suspension system 18 connected thereto to minimize vibration. The drive mechanism 23 also operates a pump 43 (FIG. 2) used for recirculating laundry liquid and for draining the tub 19 and basket 21 of laundry liquid. The drive mechanism 23, including components such as a transmission housing 32 and a motor housing 42, shown in FIG. 2, are suspended from a mounting plate 25 by mounting means such as a bolt and sleeve arrangement 36. Portions of hoses 43*a*, associated with the pump 43, are also illustrated in FIG. 2. The tub 19 is also mounted to the mounting plate 25 by means of bolts such as 26. A grommet 41 maintains a water-tight relation between the tub 19 and a spin tube encasement column 40. A constant torque clutch means 35A and a brake means 35 are also provided to operate in association with a spin tube 107, and are mounted between the mounting plate 25 and the transmission housing 32.

The agitator 22 is attached to an agitator shaft 30 by a nut and threaded shaft portion attachment means 31 and the spin basket 21 is attached to the spin tube 107 by a drive block attachment means 34. The shaft 30 is received at its lower end in a receptacle 33 in the housing 32 and rotates on a bearing 39 and a bearing surface 37.

Figure 3:
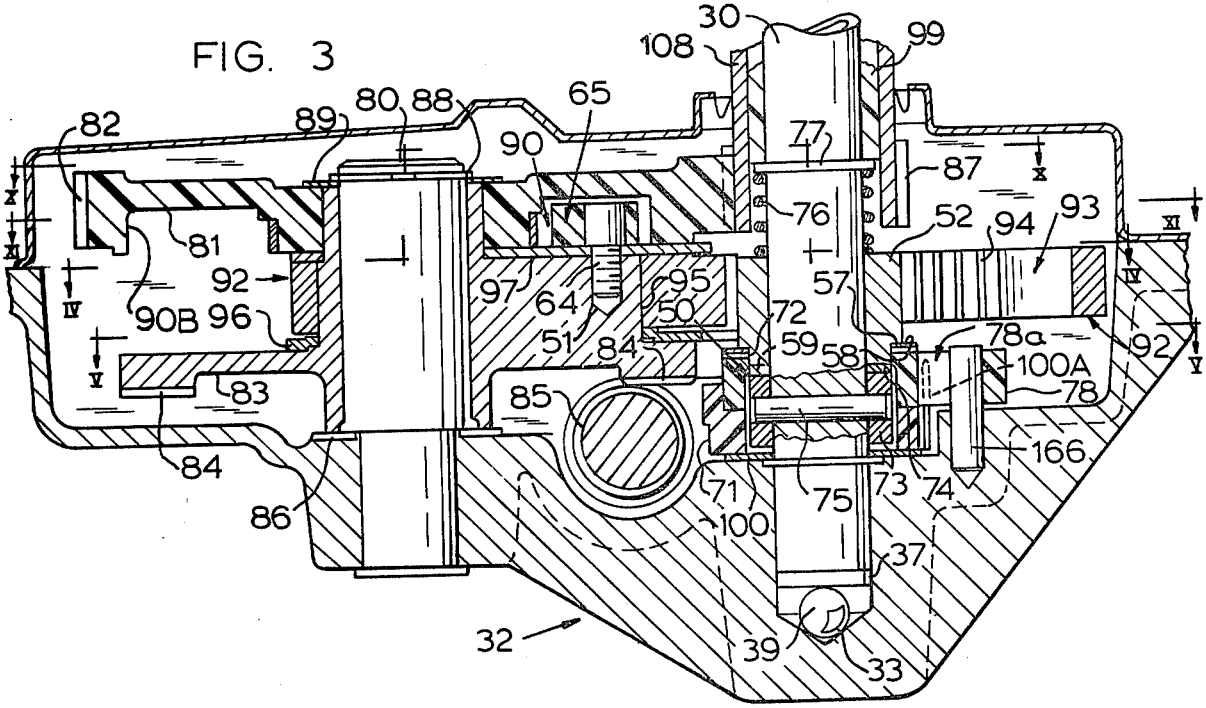
FIG. 3 is an enlarged sectional view of the clutch and spin delay mechanism of the laundry appliance of FIG. 1.
Figure 4:
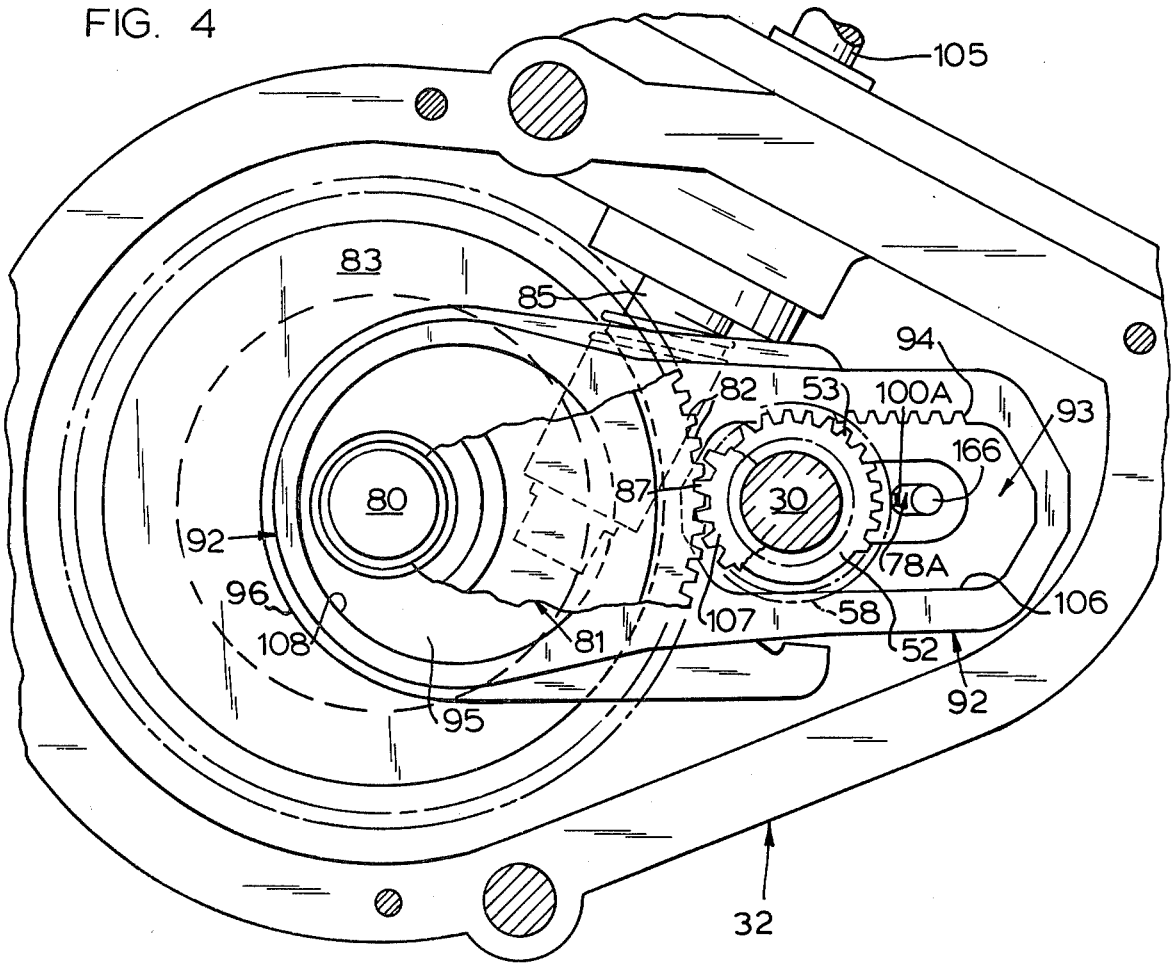
FIG. 4 is a sectional view partially broken away taken along line IV—IV of FIG. 3.

Referring to FIGS. 3 and 4, a worm gear 85 is carried on one end of a drive shaft 105, the other end of which is connected to the prime mover motor housed in the housing 42 (FIG. 2). The worm gear 85 engages teeth 84 disposed circumferentially on a lower surface of a main drive gear 83. The drive gear 83 is rotatably mounted on a jack shaft 80 and rests on a bearing washer 86. An upper portion of the drive gear 83 has an eccentric 95 integrally formed thereon. One end of a rack 92 has an opening for receiving the eccentric and operates in slidable movement therewith. A bearing plate 97 is positioned above the rack 92 on the eccentric 95 and held in place by a stud 64 which is received in a receptacle 51 in the eccentric 95. Mounted above the bearing plate 97 and concentric with drive gear 83 is a spin gear 81 having teeth 82 which engage teeth 87 on a spin pinion 108 rotatable about agitator shaft 30 and which is selectively coupled by the constant torque clutch means 35A and the brake means 35 to the spin tube 107. All elements mounted on the jack shaft 80 are maintained in adjacent relation by a cover plate 89 which is held in place by a snap ring 88.

An opposite end of the rack 92 has a loop 93 which surrounds agitator shaft 30. A row of teeth 94 are formed on one side of the loop 93 and engage teeth 53 formed on a portion of the exterior of an agitate pinion 52 rotatably mounted about the agitator shaft 30. The side of the loop 93 opposite the teeth 94 has a smooth bearing surface 106 movable against a portion of the exterior of the pinion 52 having no teeth thereon, thereby insuring complete engagement of the teeth 53 on the agitate pinion and the teeth 94 on the rack. As the eccentric 95 is rotated by the main gear 83, a reciprocal motion in a plane normal to the agitator shaft 30 is imparted to the rack 92. This reciprocatory motion is transferred to the agitate pinion 52 by means of engagement of the teeth 94 and 53, causing an oscillatory motion in the agitate pinion. This oscillatory motion is then transferred to the agitator shaft 30 through a jaw clutch means 50 described below.

Figure 9:
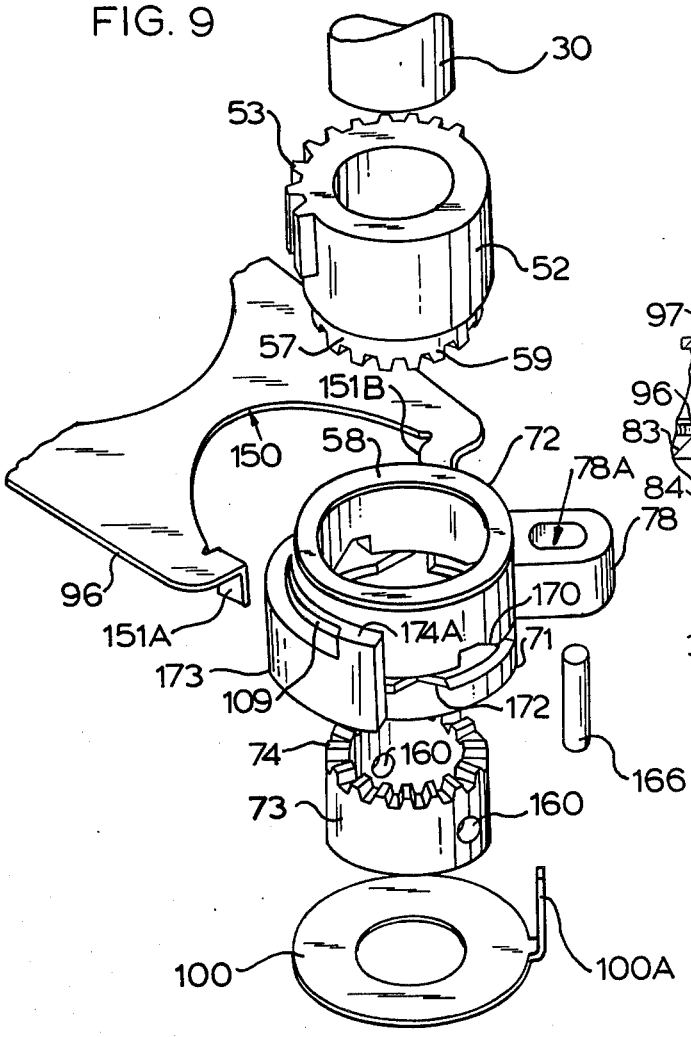
FIG. 9 is an exploded view of the clutch mechanism of FIG. 6.

The agitate pinion 52 has a second set of teeth 59 integrally formed on a lower portion and disposed downwardly to form the driving member of the jaw clutch (See FIG. 9). The circumference of the lower toothed portion of agitate pinion 52 is slightly less than the circumference of the main portion of the pinion, thereby forming an annular ledge 57 which is normal to the agitator shaft 30. The teeth 59 on the agitate pinion 52 are arranged to engage similar teeth 74 carried on an upper surface of a sleeve or driven member 73 of the jaw clutch. The sleeve 73 has holes 160 (FIG. 9) disposed in the side walls thereof, which receive a pin 75. The pin 75 also passes through a bore 161 disposed in the agitator shaft 30. Insertion of the pin 75 in the holes 160 and the bore 161 maintains the sleeve 73 in co-rotatable relation to the agitator shaft 30. Although the agitate pinion 52 is free to rotate about the agitator shaft 30, when the teeth 59 and 74 are engaged, the oscillatory motion of the pinion 52 is transferred to the sleeve 73 so that the motion is in turn transferred to the agitator shaft 30.

Figure 6:
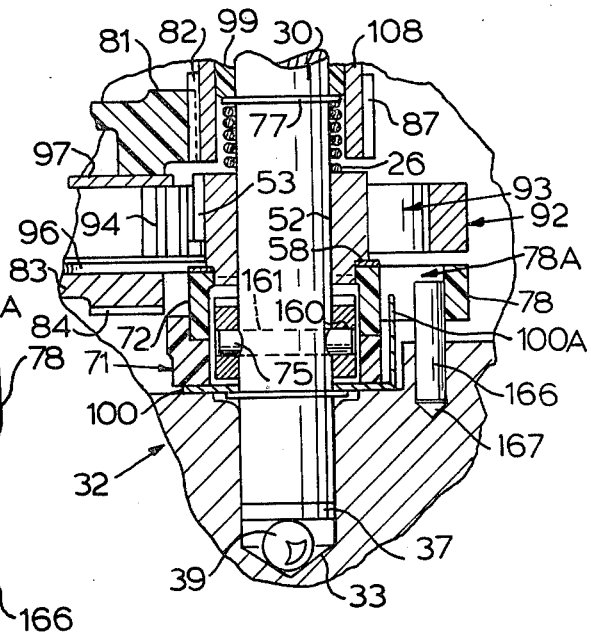
FIG. 6 is a detail sectional view of the clutch mechanism shown in FIG. 3.

As shown in FIG. 6, teeth 59 and 74 are maintained in engagement by means of a biasing spiral spring 76 which abuts an upper surface of the pinion 52. An upper portion of the spring 76 bears against a snap ring 77 which is maintained in position by being placed in a circumferential groove (not shown) in the agitator shaft 30.

Figure 7:
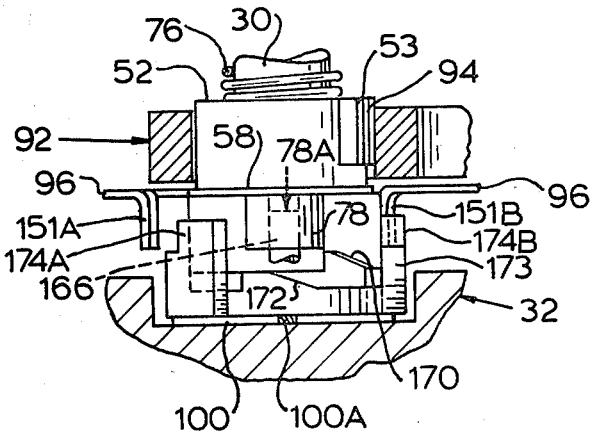
FIG. 7 is a view taken along line VII—VII of FIG. 6.

It is desired to maintain the jaw clutch teeth 59 and 74 in engagement to oscillate the agitator 22 only during the agitate portion of the laundry appliance cycle, and to disengage the teeth 59 and 74 during a spin portion of the cycle so that the agitator is free to rotate with the spin basket 21. When this sequence of events is repeated, it is then desirable to re-engage the teeth 59 and 74 to allow the oscillatory motion of the agitator to again result. Referring to FIGS. 6, 7 and 9, engagement and disengagement of the teeth 59 and 74 is accomplished by cam means including a pair of collars 71 and 72, disposed between the agitate pinion 52 and a base washer 100 and surrounding the agitator shaft 30 and sleeve 73. The upper collar 72 has a plurality of downwardly extending cam ramp surfaces 170, and the lower collar 71 has the same number, for example three, upwardly extending mating cam ramp surfaces 172. Both collars 71 and 72 are free to rotate about the agitator shaft 30. The upper collar 72 is maintained in a rotationally stationary position relative to the agitator shaft 30 by means of a radially protruding anchor 78 which has a bore 78A vertically disposed therein. A stud 166 inserted into vertical bore 78A and extending into a receptacle 167 in the housing 32 allows limited vertical motion of the upper cam member 72 in relation to the agitator shaft 30, but prevents rotational movement relative thereto. A vertical pin 100A extending from the base washer 100 also extends into the vertical bore 78A in the anchor 78 so that rotation of the base washer 100 is also prevented.

The lower collar 71 has an exterior portion 173, with two upwardly extending lugs 174A and 174B mounted thereon approximately 140° apart. A thin wall web member 109 extends between the lugs 174A and 174B to prevent interference between a shifter fork 96 and upper collar 72. An appropriate force imparted to the lugs 174A and 174B will thus rotate the lower collar 71 in an appropriate direction to effect engagement or disengagement of the cam ramp surfaces 170 and 172. When the cam ramp surfaces 170 and 172 are disengaged, the upper cam member 72 is raised the height of the cam ramp surface 172 and pushes against the ledge 63 on the pinion 52 through washer 58, thereby raising the pinion by an identical distance to disengage the jaw clutch teeth 59 and 74. The spring 76 is compressed slightly to allow such movement.

The appropriate force to rotate the lower collar 71 is applied to the lugs 174A and 174B by the shifter fork 96. The shifter fork 96 is also operated by the eccentric 95 and is located between the rack 92 and the main drive gear 83 (See FIGS. 3 and 4). A recess 150 is provided at one end of the shifter fork 96 (FIG. 9), so that the shifter fork 96 may partially surround the upper collar 72. A pair of tynes 151A and 151B extend downwardly from the shifter 96 and are arranged to abut lugs 174A and 174B respectively.

Figure 5:
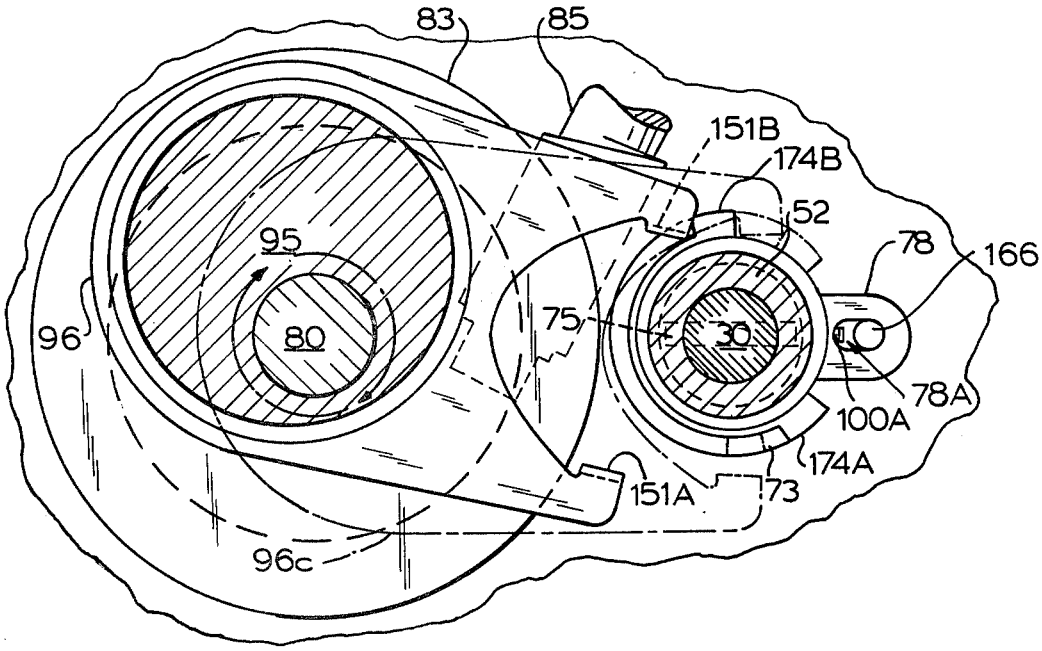
FIG. 5 is a sectional view, partly broken away, taken along line V—V of FIG. 3.
Figure 8:
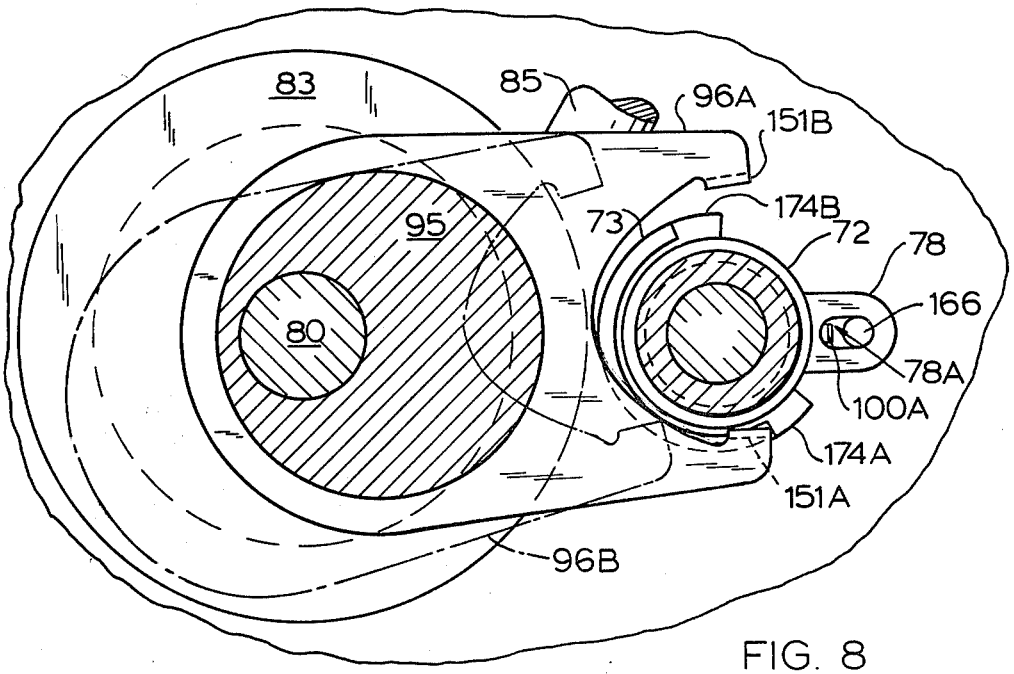
FIG. 8 is a schematic view of the shifter mechanism of FIG. 3 showing the shifter fork in various positions during the cycle of operation.

Operation of the shifter fork is demonstrated in FIGS. 5 and 8. The position of the tynes 151A and 151B with respect to the lower collar 71 is determined by the direction of rotation of the eccentric 95. The shifter fork 96 is acted upon by the frictional drag forces created between the shifter fork 96, the rack 92, the upper surface of the drive gear 83 and the outer peripheral surface of the eccentric 95.

The positioning of the shifter fork 96 during the agitate portion of a wash cycle is shown in FIG. 5. The drive gear 83 is being driven in a clockwise direction by the worm 85. The shifter fork 96 will thus be moved between positions shown by solid line 96 and dashed line 96C, so that the tyne 151B abuts against the lug 174B. The lower cam member 71 will thus be rotated in a clockwise direction so that the cam ramp surfaces 170 and 172 will be driven into mating engagement, and there will be no space between the lower collar 71 and the upper collar 72. Thus, the teeth 59 on the pinion 52 and the teeth 74 on the sleeve 73 will be moved into engagement under the influence of biasing spring 76. The oscillatory motion of the agitate pinion 52 will therefore be transferred to the agitator shaft 30, so that the agitator 22 will oscillate in the tub 20.

When the main gear 83 is rotated in a counterclockwise direction for the spin portion of the cycle, as shown in FIG. 8, the shifter fork 96 will be changed from the position shown in FIG. 5 to the position shown by the dashed line 96B, and the solid line 96A. The tyne 151A will abut the lug 174A imparting a limited counterclockwise rotation to the lower cam member 71 as the eccentric 95 rotates, thereby disengaging the cam ramp surfaces 170 and 172 as shown in FIG. 7. The upper cam member 72 will thus be raised a height equal to the height of the ramp surface 172. The upper collar 72 abuts the washer 58 and thus the ledge 63 on the pinion 52 so that the pinion 52 is also raised an identical height so that the teeth 59 and 74 are disengaged. The spiral spring 76 is compressed slightly to allow this change in position.

During the spin portion of the cycle, the spin basket 21 will be driven by the spin gear teeth 82 about engaging teeth 87 carried on spin pinion 108. Rotation of the spin pinion 108 causes operation of the spin clutch and basket brake mechanism to effect rotation of the clothes basket 21.

During both clockwise and counterclockwise rotation of the main drive gear 83, the tynes 151A and 151B extend a sufficient distance toward agitate shaft 30 to prevent complete disengagement of the shifter fork 96 away from the shaft. Operation of the shifter fork 96 is such that approximately one rotation of the eccentric 95 is necessary to insure complete disengagement of the jaw clutch means 50. In order that no rotation be transferred to the spin basket 21 by means of the spin gear 71 until complete disengagement of the clutch has occurred, it is contemplated by the present invention to effect a delay of a period of one rotation of the eccentric 95 to insure such disengagement. This is important to prevent rotation of the spin basket 21 while the agitator is still being driven in an oscillatory manner because the operation of both the agitator and the spin basket at the same time can cause overloading of the motor, overstressing of other parts in the drive system, or damage to a clothes load within the basket.

Figure 12:
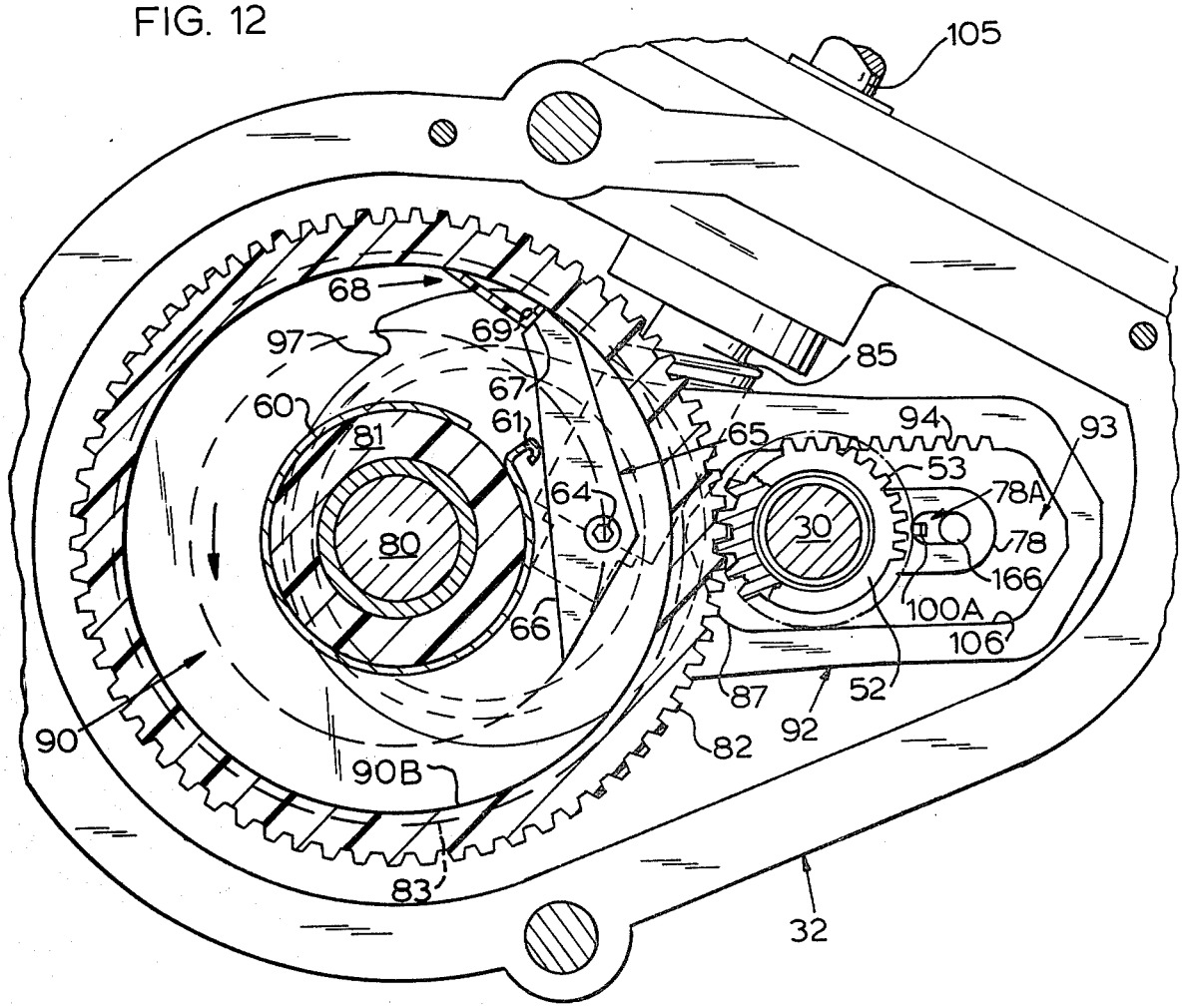
FIG. 12 is a sectional view, partly broken away, taken along line XI—XI of FIG. 3, showing operation during a counterclockwise rotation of the main drive gear.
Figure 11:
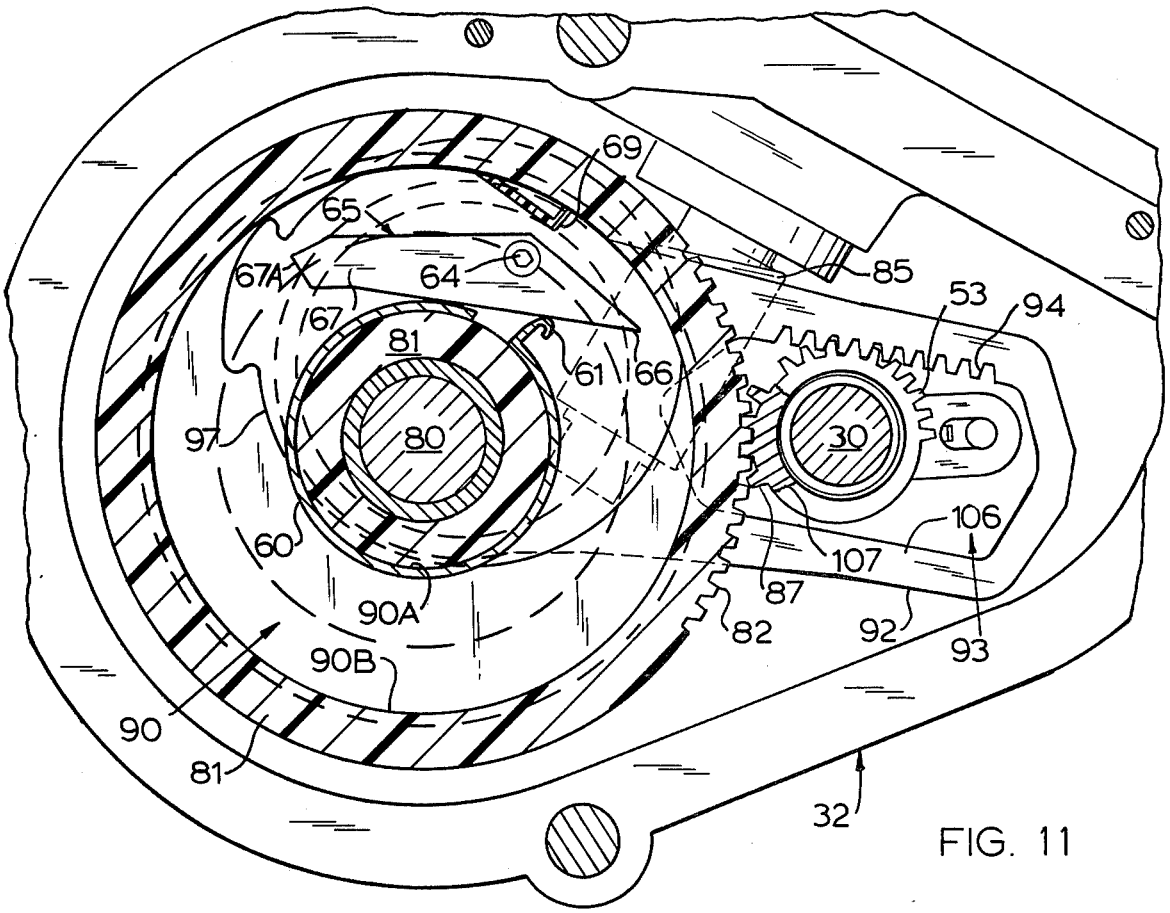
FIG. 11 is a sectional view, partly broken away, taken along line XI—XI of FIG. 3, showing operation during clockwise rotation of the main drive gear.

Referring to FIGS. 3, 11 and 12, this delay is effected by a delay mechanism including a pawl 65 pivotally mounted on the stud 64. The pawl 65 has a first pointed end 66 and a second end having a flat abutment surface 67. An actuator clip 60 having a radially outwardly extending tang 61 is fitted around the inner wall 90A of an annular channel 90 formed in the lower side of the spin gear 81.

When the main gear 83 rotates in a clockwise or agitate direction (FIG. 11), the end 66 of the pawl 65 is moved by the stud 64 into contact with the tang 61 of the clip 60. The pawl 65 is thereby pivoted counterclockwise about the stud 64 so that the opposite end flat abutment surface 67 of the pawl 65 is moved away or decoupled from a radially inwardly extending surface 69 carried on the outer wall 90B of the annular channel 90. There is thus no engagement of the surfaces 69 and 67 due to the counterclockwise rotation of the pawl 65. In this clockwise direction of rotation of gear 83 and eccentric 95, when the pawl 65 contacts the tang 61, there is sufficient force to cause the clip 60 to slip on the wall 90A. Thus, the main gear 83 rotates freely beneath the spin gear 81 while the pawl 65 rotates the clip 60 on the wall 90A and the spin gear 81 remains stationary with respect thereto.

When rotation of the main gear 83 is reversed to a counterclockwise or spin direction, by means of sequential control means 15 reversing the direction of rotation of the motor, the integral eccentric 95 on the main gear 83 will also be rotated in the counterclockwise direction as shown in FIG. 12. When rotating in this direction, the pawl 65 moves against the tang 61 which pushes the abutment surface 67 radially outwardly. As the eccentric continues to turn, the flat abutment surface 67 is rotated into contact or coupled to the inwardly extending surface 69 causing co-rotation of the spin gear 81 with the eccentric 95. The rotational movement of the main gear 83 will thus be transferred to the spin gear 81 so that the two gears rotate together.

Depending on the position of the pawl 65 with respect to the inwardly extending surface 69 when the direction of the motor is reversed to the spin direction, the delay between reversal and the time at which surface 67 begins to drive against surface 69 will be between substantially one revolution and substantially two revolutions of the main drive gear 83. One revolution delay is effected when the abutment surface 67 is immediately in contact with the surface 69 upon contact with tang 61. Substantially two revolutions of delay occur when the abutment surface 67 is just past surface 69 upon contact with tang 61 and the surface 67 must therefore travel one further revolution against wall 90B before contacting surface 69. Thus, engagement of the abutting surfaces 67 and 69 cannot occur until at least substantially one complete revolution of the main drive gear 83 has resulted after the change in direction of the main drive gear 83 when the control signals a spin period following an agitate period. It is thus insured that a delay of at least one rotation of the spin gear 81 will result before the spin gear 81 begins to rotate the basket 21 to insure that the agitate jaw clutch is disengaged before the basket begins to spin.

Various changes and modifications of the invention may be apparent to those skilled in the art, however, it is the intention of the applicant to embody within the patent warranted hereon all such changes and modifications as may reasonably and properly be included within the scope of applicant's contribution to the art.

The embodiments of the invention in which an exclusive property or privilege is claimed are defined as follows:

1. In an automatic laundry appliance including,
- a motor selectively coupled to a first drive means for agitating a clothes load and a second drive means for spinning a clothes receptacle containing said clothes load, and
- a presettable sequential control means for controlling a cycle of operation including a period when said first drive means is decoupled followed by a period when said second drive means is coupled to said motor;
- a delay means for delaying coupling of said second drive means until said first drive means is completely decoupled comprising:
  - an automatically actuatable rotating engagement means for drivingly engaging said second drive means; and
  - a means for delaying engagement of said engagement means with said second drive means for a period of substantially one revolution of said engagement means after said engagement means has been automatically actuated by said control means operating through said sequence.

2. In an automatic laundry appliance having
- a rotatable clothes receptacle,
- a vertical agitator within said receptacle,
- a reversible motor and associated drive means for driving said agitator in oscillatory motion and said receptacle in rotary motion, and
- a control means controlling a cycle of operation including a period of driving said agitator and a period of driving said receptacle;
- a coupling means included in said drive means, said coupling means comprising:
  - a main drive gear driven by said motor;
  - an automatically actuated engagement lever pivotally mounted on said main drive gear to selectively co-rotate a second drive gear with said main drive gear, said emgagement lever having a first position disengaging said gears and a second position engaging said gears; and
- a delay means for moving said lever from said first position to said second position after a delay of substantially one revolution of said main drive gear, whereby a beginning of said receptacle rotary motion is delayed said one revolution after said oscillatory motion of said agitator has ended.

3. The invention of claim 2 wherein said delay means is a tang co-rotatable with said second drive gear which moves said lever to engage said gears after a reverse in direction of rotation of said motor.

4. In an automatic laundry appliance having
- a rotatable clothes receptacle,
- a vertical agitator within said receptacle, and
- a reversible motor and associated drive means for driving said agitator in oscillatory motion and said receptacle in rotary motion,
- a coupling means included in said drive means, said coupling means comprising:
  - a main drive gear driven by said motor;
  - an eccentric mounted on said main drive gear;
  - a rack and pinion operable by said eccentric for transmitting oscillatory motion to said agitator;
  - a clutch for engaging and disengaging said pinion and said agitator;
  - an automatically actuatable engagement lever pivotally mounted on said eccentric engageable to co-rotate said main drive gear with a second drive gear for driving said receptacle,
    - said engagement lever having a first position disengaging said gears and a second position engaging said gears,
    - said engagement lever actuated by a change in direction of rotation of said motor; and
  - a tang co-rotatable with said second drive gear for moving said engagement lever from said first position to said second position, said tang moving said engagement lever into said second position after substantially one revolution of said main drive gear after a reverse in direction of rotation of said motor, whereby a delay of one revolution of said main drive gear is provided between an end of said oscillatory motion and a beginning of said rotary motion.

5. In an automatic laundry appliance including,
- a rotatable clothes receptacle,
- a vertical agitator within said receptacle, and
- a reversible drive motor and associated drive means for driving said agitator in oscillatory motion and said receptacle in rotary motion;
- a coupling means included in said drive means, said coupling means comprising:
  - a main drive gear driven by said motor;
  - an eccentric mounted on said main drive gear;
  - a rack and pinion operated by said eccentric for engaging said main drive gear with said agitator for transmission of oscillatory motion to said agitator;
  - a clutch means controlled by said eccentric for engaging and disengaging said main drive gear and said agitator, said clutch means having a shifter fork which pushes against a cam member in a direction which is the same as the direction of rotation of said main drive gear;
  - a second drive gear for driving said receptacle in rotary motion, said second drive gear mounted co-axially with said main drive gear and having an annular channel in a bottom surface thereof and a first abutment surface extending a distance radially inwardly from an outer wall of said channel;
  - an engagement lever pivotally mounted on said eccentric and having a second abutment surface at one end thereof engageable with said first abutment surface of said second drive gear;

an actuator means frictionally coupled to an interior hub of said second drive gear which forms an inner wall of said channel, said actuator means being in contact with a sloping side wall of said engagement lever such that during rotation of said lever in a first direction said actuator means moves an end of said lever having said second abutment surface out of engagement with said first abutment surface of said second drive gear, and during rotation of said lever in an opposite direction of rotation said actuator means moves said end of said lever having said second abutment surface thereon into engagement with said first abutment surface of said second drive gear causing co-rotation of said second drive gear with said main drive gear; and said sloping side wall of said engagement lever having a slope such that substantially one revolution of said engagement lever must occur before said actuator means moves said second abutment surface into engagement with said first abutment surface.

6. The invention of claim 5 wherein said actuator means is a circular clip tensioned around an inner hub of said second drive gear, said clip having a tang attached to one end thereof extending radially outwardly a distance into said channel.

7. In an automatic laundry appliance, a rotatable clothes receptacle, a vertical agitator within said receptacle, a motor for driving said agitator in oscillatory motion and said receptacle in rotary motion, a control means providing a cycle of operation including a first period of driving said agitator and a second period of driving said receptacle, a transmission coupled between said motor and said receptacle comprising:

a main drive gear driven by said motor;

an eccentric mounted on said main drive gear;

a rack and pinion operated by said eccentric for transmitting oscillatory motion to said agitator;

a clutch means controlled by a shifter fork operated by said eccentric for engaging and disengaging said pinion from said agitator;

a spin drive gear engageable for co-rotation with said main drive gear;

means for engaging said spin gear with said main drive gear for co-rotation therewith; and means for delaying engagement of said main drive gear and said spin gear for a period of one revolution of said main drive gear after a change in direction of rotation of said motor has occurred.

8. The appliance of claim 7 wherein said means for engaging said main drive gear and said spin gear comprises:

an automatically actuatable engagement lever pivotally mounted on said eccentric;

an abutment surface extending radially inwardly from an outer wall of an annular channel in a bottom of said spin gear, said engagement lever rotating in said channel; and an actuator means for moving said engagement lever into engagement with said surface, said actuator means operable to move said lever into engagement with said surface only when said lever is moving in one direction of rotation, and said lever having a surface contacting said actuator means such that one revolution of said engagement lever is required before engagement of said lever with said surface of said spin gear occurs.

9. The appliance of claim 8 wherein said actuator means is comprised of a circular clip tensioned around an inner hub of said spin gear and having a tang at an end thereof extending radially outwardly a distance into said channel.

* * * * *